US005964211A

United States Patent [19]

Sargunam et al.

[11] Patent Number: 5,964,211

[45] Date of Patent: Oct. 12, 1999

[54] PYROLYTIC SELF-CLEANING GAS OVEN

[75] Inventors: Issac P. Sargunam; Joseph E. Kelley; Richard J. Arntz, all of Cleveland, Tenn.

[73] Assignee: Maytag Corporation, Newton, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,801

[22] Filed: Nov. 20, 1996

[51] Int. Cl.[6] ..... A21B 1/00

[52] U.S. Cl. ..... 126/19 R; 126/273 A; 219/413

[58] Field of Search ..... 219/412, 413, 219/492, 493; 126/19 R, 273 R, 21 A, 273 A

[56] References Cited

U.S. PATENT DOCUMENTS

| | | | |
|---|---|---|---|
| 3,121,158 | 2/1964 | Hurko | 126/273 R |
| 3,590,804 | 7/1971 | Welshofer et al. | 126/21 A |
| 3,612,032 | 10/1971 | Kweller | 126/21 A |
| 4,369,352 | 1/1983 | Bowles | 219/413 |
| 4,763,638 | 8/1988 | Hurley et al. | 126/273 R |
| 5,038,748 | 8/1991 | Lockwood et al. | 126/21 A |
| 5,083,010 | 1/1992 | Henry et al. | 219/413 |
| 5,286,943 | 2/1994 | Has | 219/413 |
| 5,343,020 | 8/1994 | Waigand et al. | 219/413 |
| 5,662,465 | 9/1997 | Kano | 126/19 R |

*Primary Examiner*—Carroll B. Dority
*Attorney, Agent, or Firm*—Zarley, McKee, Thomte, Voorhees & Sease

[57] ABSTRACT

A method and device for cleaning the oven cavity of a pyrolytic self-cleaning oven without using a broil element or burner. The method includes using a bake burner to maintain the temperature of the oven cavity during the first stage of the self-cleaning process at a temperature sufficiently low such that cooking residues are baked onto the oven walls and bottom without producing excessive levels of smoke. During the second stage of the self-cleaning process, the temperature inside the oven cavity is raised to clean away the baked-on residues while still maintaining acceptable levels of smoke.

10 Claims, 2 Drawing Sheets

PYROLYTIC SELF-CLEANING GAS OVEN

BACKGROUND OF THE INVENTION

The present invention relates to cooking appliances, particularly pyrolytic self-cleaning gas ovens. More particularly, the present invention relates to a method for cleaning a pyrolytic gas oven without using a broil element or burner.

During roasting, cooking, and baking the insides of an oven become soiled in various ways. Residues from cooked food and condensation of vapor components stick to the oven walls of the cooking cavity, especially towards the bottom of the cooking cavity.

Typically a pyrolytic gas self-cleaning oven utilizes a broil burner or element located near the top of the cooking cavity which is turned on fully during the first stage of the self-cleaning process to bake the cooking soil, grease, and other residue to the walls of the oven cavity. Once the residue has been baked onto the oven walls and bottom, the bake burner is turned on to raise the temperature of the oven to a self-cleaning temperature. Because the soil and residue sticking to the walls and bottom of the oven are subjected to a thermal cracking process by the long-lasting heating at approximately 825° F. and above during the second stage, the increase in temperature does not create excessive amounts of smoke. Instead, the residues are converted into decomposition products, such as water, short-chained hydrocarbons, aeromatics, and ashes. The gaseous products can be carried out of the oven by the ventilation system during the self-cleaning, and the remaining residue can be simply removed from the stove in the form of ashes.

Use of a separate broil burner or element towards the top of the cooking cavity adds considerably to the cost of the product. Unfortunately, consumers who do not broil and prefer a self-cleaning oven must still pay the premium for the second burner system which is normally required for an effective self-cleaning process to maintain smoke at acceptable levels. In the case of consumers who broil, use of a broil burner or element during the first stage of the self-cleaning process increases the temperature to which door lock mechanisms and other components are subjected. Prior art attempts to self-clean without a broil element have been unsuccessful. Because most of the cooking residues collect towards the bottom of the oven near the bake burner, turning on the bake burner fully during the first stage creates excessive smoke. For these reasons, there is a need for a device and method for performing a self-cleaning process which maintains smoke at acceptable levels without the use of an additional broil element or burner.

A general object of the present invention is the provision of an improved pyrolytic self-cleaning gas oven.

A further object of the present invention is the provision of a method for effectively cleaning an oven cavity without the use of a separate broil element or burner.

A still further object of the present invention is the provision of a method for cleaning an oven cavity which is simple, effective, and economical.

These as well as other objects, features and advantages of the present invention will become apparent from the following specification and claims.

SUMMARY OF THE INVENTION

The present invention relates to a method for cleaning the oven cavity of a pyrolytic self-cleaning oven having a bake burner or element, which obviates the need for a separate broil element or burner or the use of an existing broil element or burner during the self-cleaning cycle. The method includes activating the burner element, maintaining the temperature of the cooking cavity below a predetermined initial temperature during the first cleaning stage, and then raising the temperature of the cooking cavity to a self-cleaning temperature during the second cleaning stage. Important to the method is that the temperature of the cooking cavity be maintained at an initial temperature where the soil, grease, and other cooking residues are baked onto the oven walls without producing unacceptable levels of smoke. In the second stage of the self-cleaning process when the temperature is raised to the self-cleaning temperature, the hardened cooking residues are removed without producing unacceptable levels of smoke.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalents which may be included within the spirit and scope of the invention.

Figure 1:
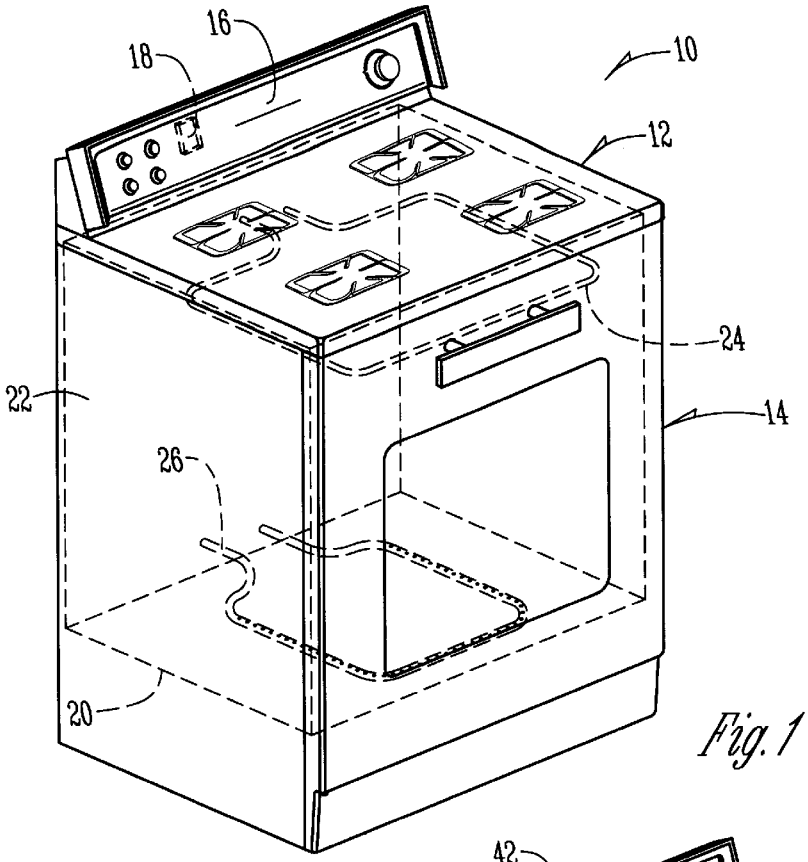
Fig.1 (prior art)
FIG. 1 is a perspective view of a prior art pyrolytic self-cleaning gas range using a broiling element.

FIG. 1 shows a prior art pyrolytic self-cleaning gas range 10 which includes a stove 12, an oven 14, and an electronic oven control panel 16 having a microprocessor 18. The oven 14 has a cooking cavity 20 housed within an oven cabinet 22. A broil element 24 is suspended inside the cooking cavity 20 and a bake burner 26 is positioned towards the bottom of the cooking cavity 20. Prior art self-cleaning gas ovens 14 utilize a separate gas burner or electric broil element 24 during the first stage of the self-cleaning process. The usual function of the broil element 24, in addition to the broil feature, is to serve as a smoke eliminator in the self-cleaning mode. Because the broil element 24 is positioned towards the top of the cooking cavity 20 and the cooking residues are generally concentrated towards the bottom of the cooking cavity 20, the broil element 24 effectively bakes soil, grease, and other cooking residues to the walls of the cooking cavity 20 without producing excessive smoke. Then, during the second stage of the self-cleaning process, the gas bake burner 26 is turned on fully and used to raise the temperature of the oven cavity 20 to a self-cleaning temperature at which the hardened residues form ashes and gaseous products without producing unacceptable levels of smoke. For those customers who do not want the broiling capability but still wish to have a self-cleaning oven, the separate broil element is an additional expense.

Figure 2:
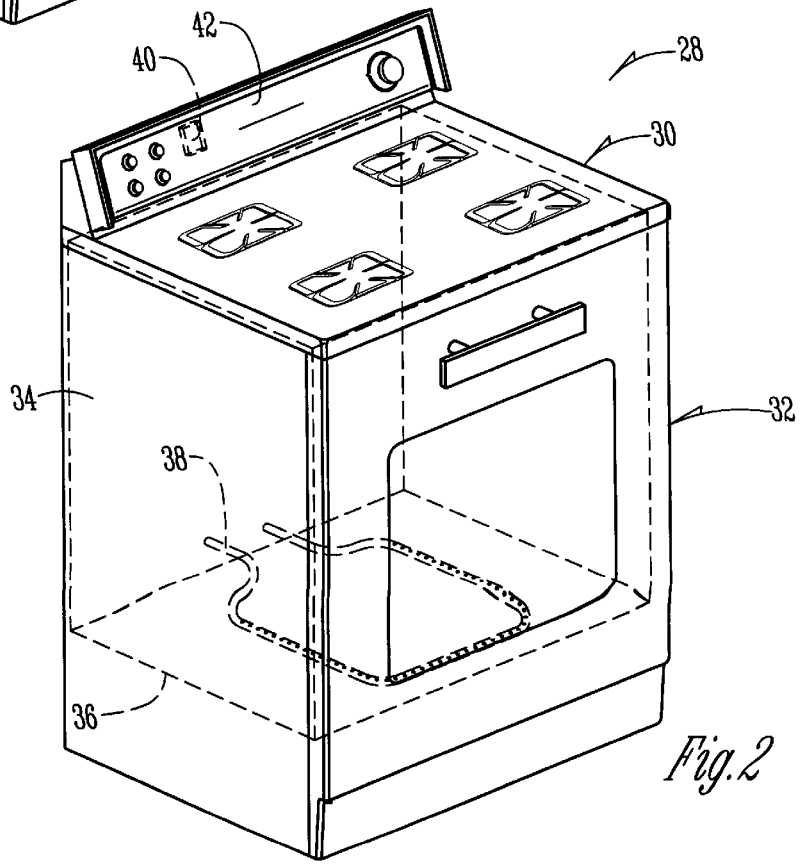
FIG. 2 is a perspective view of a pyrolytic self-cleaning gas range used for the present invention.

FIG. 2 shows generally the pyrolytic self-cleaning gas range 28 used with the present invention. This range 28 also includes a stove 30, oven 32, oven cabinet 34, and cooking cavity 36. A separate broil element is not included in the preferred embodiment of the present invention. Instead, the gas oven 26 of the present invention includes only a single bake burner 38, which is regulated by a microprocessor 40 in the electronic oven control panel 42 or, as an alternative, an electro-mechanical timing device (not shown).

A method is provided for directing the gas oven 32 through a self-cleaning process which does not utilize a separate broil element, while still maintaining acceptable levels of smoke. The temperature of the oven bottom is regulated in such a way that the temperature rise on the soiled surface is slow enough to insure that smoke is not generated. In general, the control logic resident in the electronic oven control panel 42, or the electro mechanical timing device, regulates the single bake burner to maintain a sufficiently low temperature during the first stage of the self-cleaning process such that cooking residues are baked onto the sides of the oven walls and oven bottom without producing unacceptable levels of smoke. Then, in the second stage of the self-cleaning process, the control logic directs the bake burner to raise the temperature inside the cooking cavity 36 to a self-cleaning temperature at which the residues are transformed into ashes and gaseous products which are transferred through the ventilation system of the oven 32.

Figure 3:
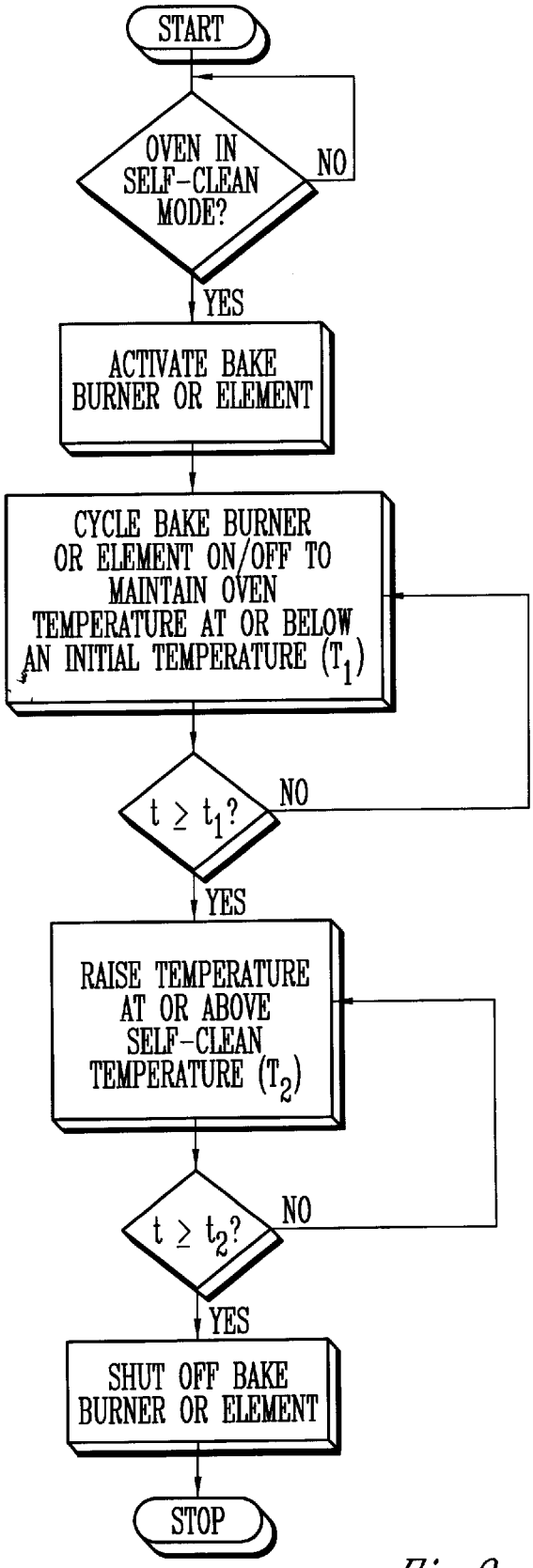
FIG. 3 is a flow chart of the preferred method for cleaning an oven cavity without a broil element.

The method which has been found most effective in cleaning the oven cavity 36 without the use of a separate broil element is set out in FIG. 3. First, a microprocessor 40 which interfaces with the electronic oven control panel 42 monitors whether the gas oven 32 is in the self-cleaning mode. Once the gas oven 32 enters the self-cleaning mode, then the bake burner is activated to begin heating the cooking cavity 36. The bake burner is cycled on and off to maintain the cooking cavity 36 at or below an initial temperature ($T_1$) for a first predetermined time ($t_1$). It is at this initial temperature ($T_1$) at which the cooking oils, greases, and residues are hardened onto the walls of the cooking cavity 36. Preferably, the cooking cavity 36 should be maintained at or below an initial temperature ($T_1$) not to exceed approximately 500° F. for approximately 42 minutes to effectively bake cooking residues onto the oven walls and avoid excessive levels of smoke. It is important that bake burner 38 is cycled on and off during this first stage of the self-cleaning process. Because most of the cooking residues are in close proximity to the bake burner 38, turning the bake burner on fully would create excessive smoke. Although the bake burner 38 can be cycled on and off in various ways, settings found most effective are to cycle the bake burner 38 on for 1.5 minutes and then off for 4¼ minutes for approximately seven cycles.

After completing this first stage of the self-cleaning process, the bake burner 38 is left on continuously to raise the temperature in the cooking cavity 36 to the desired self-cleaning temperature ($T_2$). The cooking cavity 36 remains at this self-cleaning temperature ($T_2$) for a second predetermined time ($t_2$). During this second stage of the self-cleaning process, the oils, greases, and residues previously hardened onto the walls of the cooking cavity 36 are transformed into gaseous products and ashes. The gaseous products are taken away in the ventilation system of the gas oven 32 and the ashes normally flake to the bottom of the cooking cavity 36 and can be removed after the self-cleaning process is complete. A self-cleaning temperature ($T_2$) exceeding approximately 825° F. has been found most effective. After the cooking cavity has remained at the self-cleaning temperature ($T_2$) for a second predetermined time ($t_2$), the bake burner 38 is turned off and the cooking cavity 36 allowed to cool to room temperature.

The method of the present invention is not limited to gas ranges previously used with gas burners or electric broil elements, as it can also be used in existing electric ovens. Further, the method of the present invention can also be used with gas and electric ovens that are equipped with broil burners and elements.

What is claimed is:

1. A method for cleaning a cooking cavity of a gas oven having an oven bottom solely through use of a bake burner, the method comprising:

activating the bake burner;

maintaining the temperature of the oven bottom using the bake burner below a first predetermined temperature not to exceed about 500° F. for a first predetermined time;

raising the temperature of the oven bottom and the cooking cavity using the bake burner to a second predetermined temperature above about 825° F.; and deactivating the bake burner after a second predetermined time.

2. The method of claim 1 wherein the first predetermined time is approximately 42 minutes.

3. A method for cleaning a cooking cavity of a pyrolytic gas oven having an oven bottom solely through use of a bake burner, the method comprising:

activating the bake burner;

cycling the bake burner on and off to maintain the temperature of the oven bottom at or below a first predetermined temperature not to exceed about 500° F. for a first predetermined time;

raising the temperature of the oven bottom and the cooking cavity using the bake burner to a second predetermined temperature above about 825° F.; and deactivating the bake burner after a second predetermined time.

4. The method of claim 3 wherein the first predetermined time is approximately 42 minutes.

5. The method of claim 3 wherein the bake burner is periodically cycled on and off to limit the temperature during the first predetermined time.

6. The method of claim 5 wherein the bake burner is cycled on for approximately 1.5 minutes and off for approximately 4.5 minutes.

7. The method of claim 6 wherein the bake burner completes at least seven cycles.

8. The method of claim 3 wherein the temperature of the oven cavity is raised without using a broil element.

9. A self-cleaning gas oven comprising:

a cooking cabinet having a cooking cavity housed therein;

a bake burner housed within the cooking cavity;

a control panel for controlling the bake burner; and a control interfacing with the control panel for performing the steps of activating the bake burner, maintaining the temperature of the cooking cavity using the bake burner below approximately 500° F. for a first predetermined time, raising the temperature of the cooking cavity using the bake burner to at least approximately 825° F., and deactivating the bake burner after a second predetermined time.

10. The method of claim 9 wherein the control is a microprocessor controlled electronic control.

* * * * *